US008182179B2

(12) United States Patent
Bohnhoff

(10) Patent No.: US 8,182,179 B2
(45) Date of Patent: May 22, 2012

(54) SUPPORT STRUCTURE AND METHOD OF INSTALLING THE STRUCTURE

(76) Inventor: William W. Bohnhoff, Anthem, AZ (US)

( * ) Notice: Subject to any disclaimer, the term of this patent is extended or adjusted under 35 U.S.C. 154(b) by 302 days.

(21) Appl. No.: 12/612,186

(22) Filed: Nov. 4, 2009

(65) Prior Publication Data

US 2010/0107541 A1 May 6, 2010

Related U.S. Application Data

(60) Provisional application No. 61/111,430, filed on Nov. 5, 2008.

(51) Int. Cl.
*E02D 29/02* (2006.01)

(52) U.S. Cl. ..... 405/284; 405/286

(58) Field of Classification Search ..... 405/15–17, 405/19, 29, 272, 282, 284, 286; 428/138
See application file for complete search history.

(56) References Cited

U.S. PATENT DOCUMENTS 4,945,689 A 8/1990 Johnson, Jr.
5,250,340 A 10/1993 Bohnhoff
5,320,455 A 6/1994 Mattox
5,848,856 A 12/1998 Bohnhoff
6,095,718 A 8/2000 Bohnhoff
6,213,687 B1 4/2001 Broughton et al.
6,428,870 B1 8/2002 Bohnhoff
6,533,501 B1 3/2003 Callinan et al.
6,817,806 B1 11/2004 Arellanes
7,290,958 B2 * 11/2007 Blackwood ..... 405/50
2005/0284077 A1 12/2005 Spratlen et al.
2009/0142144 A1 * 6/2009 Erez et al. ..... 405/284

OTHER PUBLICATIONS

Notification of Transmittal of The International Search Report and The Written Opinion of the International Searching Authority, or The Declaration, Jan. 4, 2010, 9 pgs.

* cited by examiner

*Primary Examiner* — John Kreck
*Assistant Examiner* — Sean Andrish

(57) ABSTRACT

The present invention relates to a support structure including a plurality of mats, each mat including a substantially fixed matrix of spaced tubular rings. The mats are vertically stacked such that the tubular rings are co-extensive and form a matrix of tubular columns. Materials may be poured into the columns and into the void region between the columns, and geotextile or geomembrane-type fabric may wrap the mats and materials to form a block. The blocks may be arranged in one or more horizontal layers, and may be stacked and staggered with respect to blocks in a lower layer. A method of installing the structure is also disclosed.

13 Claims, 7 Drawing Sheets

SUPPORT STRUCTURE AND METHOD OF INSTALLING THE STRUCTURE

CROSS-REFERENCE TO RELATED PATENT APPLICATIONS

This patent application claims priority to Provisional Patent Application No. 61/111,430 filed Nov. 5, 2008 and entitled Variations of Ring and Grid Stabilizing, Storage, and Support Structures and Uses for Such Structures. The subject matter of the provisional application is incorporated herein by reference.

FIELD OF THE INVENTION

The present invention relates to the use of ring and grid structures such as those disclosed in the inventor's own U.S. Pat. Nos. 5,250,340; 5,848,856; 6,095,718; and 6,428,870. The ring and grid structures may be employed as a retaining wall, a load-bearing wall, and a support column, and for erosion protection. In one embodiment, the ring and grid structure may be employed in an above-ground or an underground storage system for liquids such as water or petroleum products.

BACKGROUND OF THE INVENTION

Many different types of materials and structures have been used for retaining walls, load-bearing walls, support columns, and erosion protection. Some of the earliest materials are wood and rocks. For example, walls of logs or wooden planks have been used to confine and retain the movement of soil in wells, mines, road embankments, and shorelines. Likewise, rocks and stones can be used for similar purposes as well as for building foundations, cellar walls, and riprap, and also to control shoreline and soil erosion. More recently, materials such as bricks, concrete, plastics, and steel have been used for such purposes.

Preferred materials and structures have several desirable properties: they should be relatively strong, stable, and resistant to deterioration. They should be inexpensive, and they should be relatively easy and quick to erect and install. The present invention relates to a support structure and a method of installing the structure that makes use of virtually all of the foregoing desirable qualities.

SUMMARY OF THE INVENTION

The present invention relates to a support structure including a plurality of mats, each mat including a substantially fixed matrix of spaced tubular rings. The mats are vertically stacked such that the tubular rings are co-extensive and form a matrix of tubular columns. Materials such as granular or aggregate materials may be poured into the columns and into the void region between the columns, and plastic, geotextile or geomembrane-type fabric may wrap the mats and materials to form a block. The blocks may be arranged in one or more horizontal layers, and may be stacked and staggered with respect to blocks in a lower layer. A method of installing the structure is also disclosed. The tubular column blocks and granular fill combine to provide both vertical and lateral load capacities much greater than the materials used independently.

BRIEF DESCRIPTION OF THE DRAWINGS

The present invention will be described with reference to the accompanying drawings, wherein.

DESCRIPTION OF A PREFERRED EMBODIMENT

Figure 1:
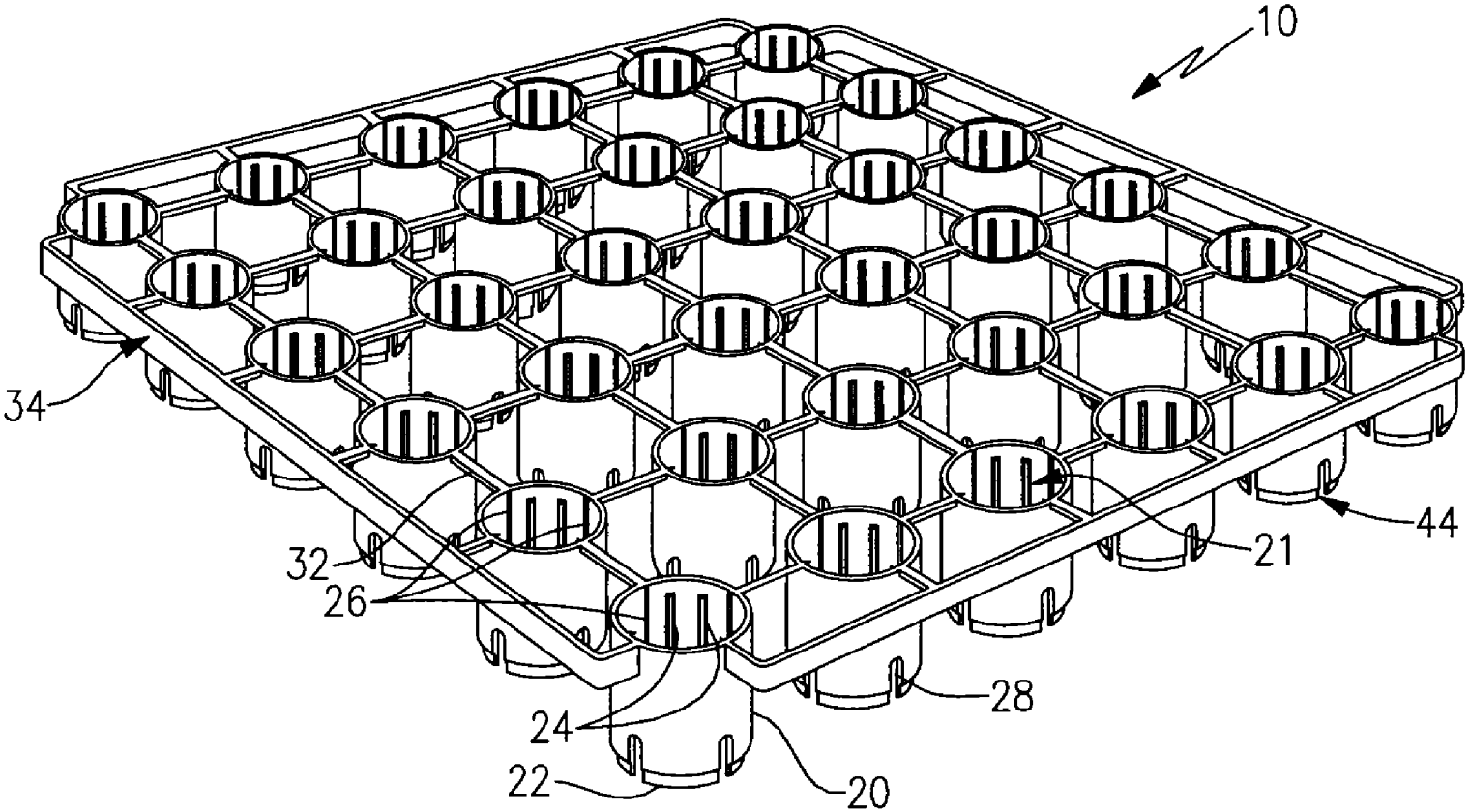
FIG.1 Prior Art
FIG. 1 is a perspective view of a mat that may be used in connection with a preferred embodiment of the support structure of the present invention.

The present invention will be described with reference to the accompanying drawings wherein like reference numerals refer to the same item.

There is shown in FIG. 1, a prior art mat 10 that may be used in connection with the support structure of the present invention. Such mat is disclosed in and is the subject of the inventor's U.S. Pat. No. 6,428,870. Alternatively, the prior art mat disclosed in and the subject of the inventor's U.S. Pat. No. 5,250,340 may be utilized in connection with the support structure of the present invention.

The mat 10 includes an array of support members 20 that each preferably possess a substantially open receiving end 21, a substantially open compression fitting 22, one or more stiffening ribs 24, one or more support ribs 26, and at least one peripheral wall opening 28. Each support member 20 preferably comprises a thin-walled cylindrical ring integrally molded from a semi-rigid thermoplastic material, and for best results, a high impact polypropylene or high density polyethylene plastic. Additionally, it should be noted that support members of other than cylindrical shape may be used, for instance, oval, hexagonal, rectangular, square, triangle, octagonal, or other cross-sectional may be utilized.

Figure 3:
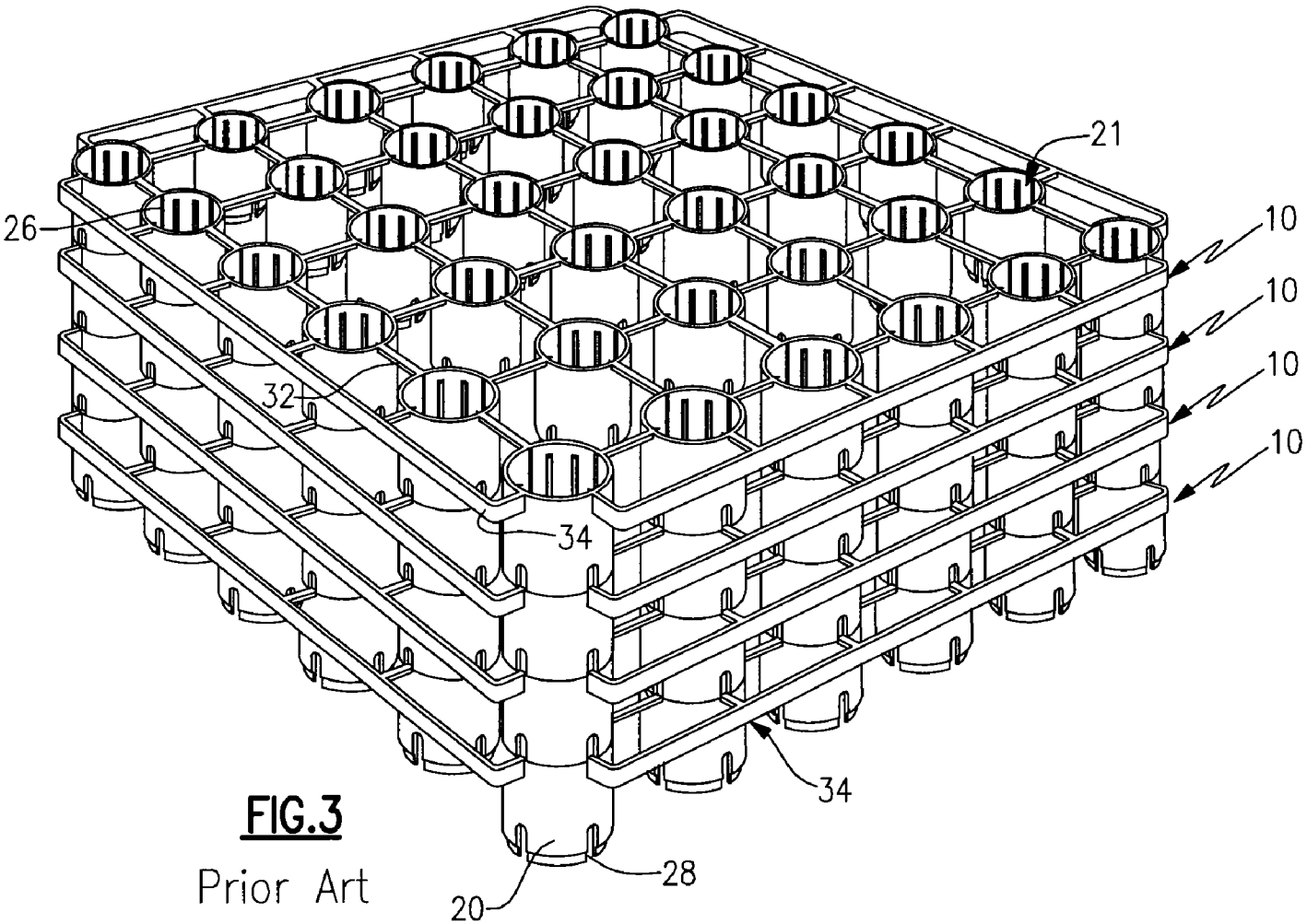
FIG.3 Prior Art
FIG. 3 is a perspective view of a plurality of mats shown in FIG. 1 arranged in a vertically stacked, nested relationship.

Referring to FIG. 3, the compression fitting 22 of a support member of an upper mat 10 preferably is designed to be axially inserted into the receiving end 21 of a support member of a lower mat 10 such that the support members 20 may be stacked in a nested relationship. The compression fitting 22 is located near the bottom of the support member 20 and extends around the perimeter of the support member 20 and longitudinally upwards to pre-selected distance, preferably about one to one and one-half centimeters, however, for best results the compression fitting 22 should not extend longitudinally higher than the peripheral wall opening 28. Additionally, the compression fitting 22 possesses a smaller outside perimeter than the receiving end 21 and preferably possesses a beveled edge to allow the support member 20 to be stacked in a vertical nested relation. A plurality of eight equi-angularly spaced fingers help align the compression fitting 22 during its insertion with the receiving end 21 of a lower support member, extend below the compression fitting 22, and are preferably beveled to allow the compression fitting 22 to be easily axially inserted into the receiving end 21 of another support member 20, as is illustrated in FIG. 3.

Four equi-angularly spaced support ribs 26 are longitudinally disposed on the interior side of the support member 20 and extend longitudinally from approximately the receiving end 21 to approximately the top of an associated peripheral wall opening 28. For best results, the support rib 26 should be located on the interior wall at approximately the same position as where the struts 32, 34, terminate on the outside wall of the support member 20. The support ribs 26, may in fact be operatively connected or integrally formed with the internal 32 or external struts 34. Additionally, the support rib 26 preferably widens gradually from the top of the support member 20. Eight stiffening ribs 24 begin below the receiving end 21 and extend past the compression fitting 22, terminating with a corresponding finger. Preferably, the upper end of the stiffening ribs 24 is recessed from the receiving end 21 a distance approximately equal to, or at least as high as, the height of the compression fitting 22. Such dimension will allow the compression fitting to be totally insertable into the receiving end, prevent the compression fitting from being inserted too deeply, allow the stacked mats to be in nested relation, and aid in the formation of a rigid, stable structure.

The stiffening ribs 24 are double in thickness below a point approximately even with the upper end of the peripheral wall openings 28. It should be noted that the stiffening ribs 24 are not required to be double in size, and this dimension is not intended to limit the invention. Each stiffening rib 24 terminates in a corresponding finger that is preferably beveled to allow for ease in axially inserting the compression fitting 22 into the receiving end 21 of another support member. The fingers extend below the compression fitting 22, and once axially inserted, aid in preventing the support member 20 from rotating with respect to mated support member. Additionally, four equi-angularly spaced peripheral wall openings 28 in the compression fitting 22 cooperate with the four corresponding support ribs 26 of the lower support member to help prevent the matrix from rotating. The support member 20 possesses four peripheral wall openings 28, that roughly divide the compression fitting 22 into four quadrants. Each quadrant preferably has two stiffening ribs 24 extending down and terminating into fingers that extend below the compression fittings 22 and the support member 20. Preferably, the fingers in each quadrant oppose each other.

Referring now to FIG. 1, preferably the compression fitting 22 possesses the same inside perimeter as the support member 20 and the receiving end 21. However, the outside perimeter of the compression fitting 22 is smaller than the outside perimeter of the receiving end 21, whereby a shelf 30 is created that will aid in stabilizing the support member 20 when vertically stacked. In another embodiment, the outside perimeter of the compression fitting 22 will approximately equal the outside perimeter of the support member 20 at the top of the compression fitting 22, but will taper inwardly towards the bottom of the compression fitting 22 such that the outside perimeter at the bottom of the compression fitting 22 is smaller than the outside perimeter at the top of the compression fitting 22. The peripheral wall openings 28 allow fluids and/or fine granular materials to flow through the support members in two perpendicular directions, laterally through each support member while the open interior of the support members and the spacing of the support members allow fluids and/or fine granular materials to flow vertically through and between the support members and laterally between the support members.

Figure 2:
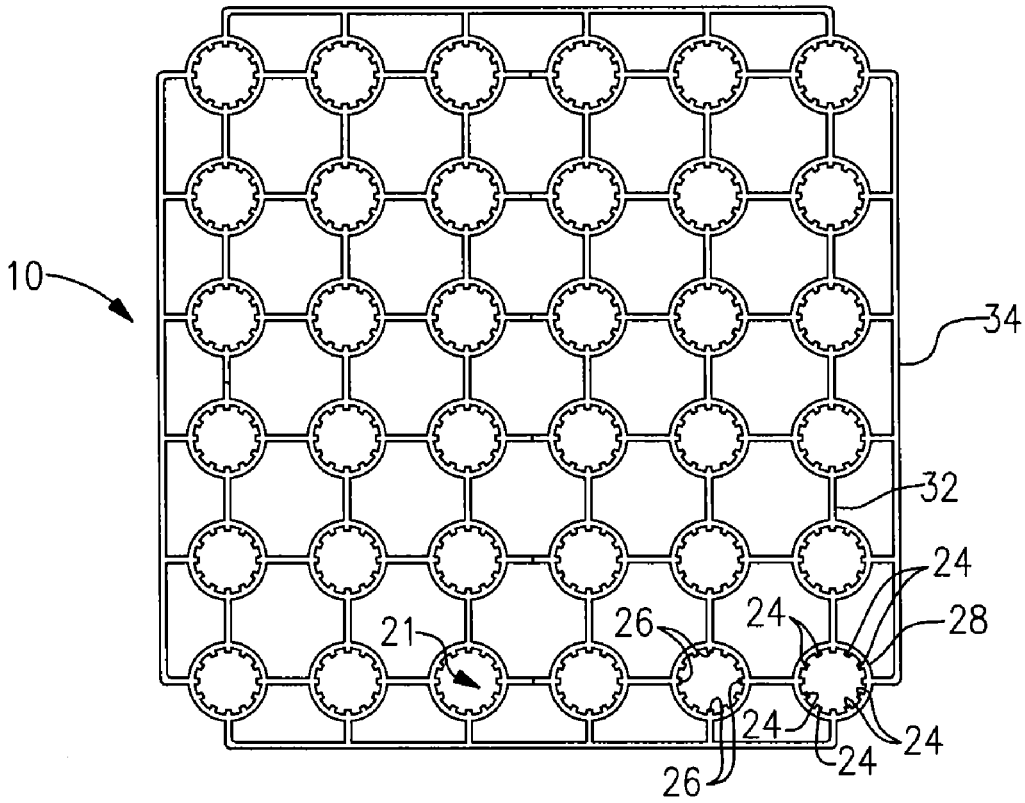
FIG.2 Prior Art
FIG. 2 is a top view of the mat shown in FIG. 1.

Referring to FIGS. 1 and 2, there is shown a plurality of support members 20 disposed in a uniform rectangular array defined by a plurality of perpendicular rows and columns defining the mat 10. Internal struts 32 operatively connected or preferably integrally molded to the support members 20 provide added strength to resist external and/or lateral soil and water pressure. For best results the internal struts 32 should be T-shaped beams. An external strut 34 is operatively connected or preferably integrally molded with a support member 20 located at the corner of mat 10. As illustrated, the external strut 34 extends along one perimeter side of mat 10, and is connected to support members 20 located at the corners of mat 10. The external strut 34 may either be connected to mat 10 at the corner support members 20, may be operatively connected or integrally molded directly to the outside wall of each support member 20 located on that perimeter side, or for best results, the external strut 34 should be operatively connected or integrally molded to every support member 20 along the perimeter side by an internal strut 32 that extends outward from each support member 20, as shown in FIG. 1. For best results the external strut should be an L-shaped beam.

The peripheral wall opening 28 extends longitudinally upward from the bottom of the compression fitting 22 to a point approximately equal to or above the compression fitting 22. Preferably, there are four openings disposed at ninety degree angular intervals positioned under a corresponding support rib 26. The sides of each peripheral wall opening 28 preferably extend longitudinally and parallel to each other, with the upper end of each peripheral wall opening 28 being preferably rounded or actuated. The peripheral wall openings 28 divide the compression fitting 22 into four quadrants, whereby each peripheral wall opening 28 is separated from another peripheral wall opening 28 by two stiffening ribs 24. The stiffening ribs 24 and the support ribs 26 provide strength and rigidity to the support member 20, extend longitudinally along the inner sidewall of each support member 20, and are operatively connected or preferably integrally molded to the support member 20. Preferably, eight stiffening ribs 24 and four support ribs 26 extend along the inner sidewall of the support member 20. The support ribs 26 are disposed at ninety degree angular intervals. The stiffening ribs 24 are preferably disposed between support ribs 26 such that there is a thirty degree angular interval between each stiffening rib 24 and between a stiffening rib 24 and a support rib 26. Both the stiffening rib 24 and the support rib 26 are preferably frusto-conical in shape.

FIG. 3 illustrates a plurality of mats 10 in stacked, nested relation. Each mat 10 is preferably substantially identical to each other mat and is constructed according to the principles outlined above. As has been illustrated, the substantially open receiving end 21, is adapted to receive the compression fitting 22 of the support member directly above. It should be noted that only four mats are shown in stacked, nested relation for the purposes of illustration, not limitation. Also, the stacks of mats may be oriented upside-down with respect to the orientation shown in FIG. 3 with the wall openings of the support members facing inwardly.

As previously mentioned, another type of mat that may be utilized in connection with the present invention is a mat disclosed in the inventor's U.S. Pat. No. 5,250,340. Such a mat includes an array or matrix of spaced tubular rings that are maintained in a spaced relationship by means of interconnecting struts or grids. It will be noted that the tubular rings of such mat are not nestable, although they could be modified to be so. It should be appreciated that such mats may be maintained in a vertically stacked relationship by using means such as one or more rods extending through the interstices of the struts in each of the stacked mats. Other means may include using a wire or rope to connect the struts of each mat.

Although two exemplary types of mats that may be utilized in the present invention have been described, it should be appreciated that a wide variety of other types of mat constructions may also be advantageously used in connection with the present invention. In addition, the two above-described mats may be advantageously modified as well. For example, the mats shown in FIGS. 1-3 may be constructed so as to eliminate any wall openings 28.

Figure 4:
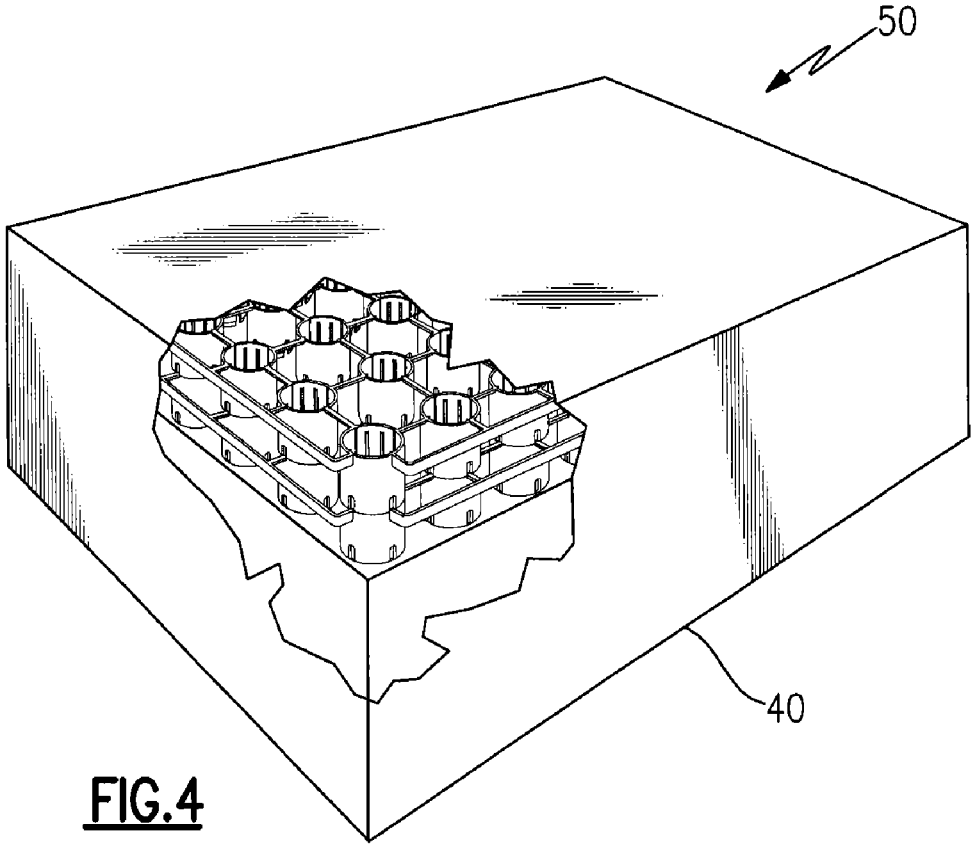
FIG. 4 is a perspective, cut-away illustration of a support structure utilizing the stacked mats as shown in FIG. 3.

Referring to FIG. 4, one or more sheet layers 40 may be placed over the faces of the stacked mats 10. The layers 40 may loosely, freely surround the stacked mats 10 or may be secured to the stacked mats 10 by means of an adhesive or other bonding agent, for example. Also, the layers 40 may be sealingly wrapped over the sides, bottom, and top of the stacked mats 10, preferably in a manner that prevents soil or other particulate migration between the interior and the exterior of the layers 40. In one embodiment, the sheet layers 40 can be fashioned of geotextile materials and/or geomembranes. Geotextiles are normally liquid permeable fabrics which, when used in association with soil, have the ability to separate, filter, reinforce, protect, or drain. Typically, such geotextiles are made from polypropylene or polyester, which come in three basic forms: woven (which looks like mail bag sacking), needle punched (which looks like felt), or heat bonded (which looks like ironed felt). Geomembranes are liquid impermeable membranes of materials that are often used as canal and pond liners, such as those used for the containment of hazardous or municipal wastes and their leachates. Some common geomembrane materials are low-density polyethylene, high-density polyethylene, polyvinyl chloride, polyurea, and polypropylene. As shown in FIG. 4, prior to encasement in the layers 40, the support members 20 of each mat 10 form a tubular column, which may be filled with a variety of materials for strength and stabilization. Preferably, the material may comprise a construction aggregate, such as sand, dirt/soil, gravel, crushed stone, slag, or recycled, crushed concrete. In other embodiments, particulate matter such as ground glass or ground rubber may be utilized. Also preferably, the particulate matter is relatively small in size in order to provide maximum strength and stability. Although the tubular columns formed by the support members 20 are relatively strong without any material being inserted therein, the addition of such material adds strength in the same manner that a paper soda straw that is empty is easier to bend than a paper soda straw filled with granular sugar. In other embodiments, the tubular columns may be filled with a curable material, such as a resin or concrete. The curable material is poured into the tubular columns while the mats 10 are in a stacked condition, and then the curable material is allowed to cure or harden. The invention further contemplates that reinforcement rods a/k/a "rebar" may be inserted vertically into the tubular columns or horizontally through the tubular columns (such as through the wall openings 28) or both prior to the curable material being poured therein, which may further strengthen the stacked mats 10.

Figure 5A:
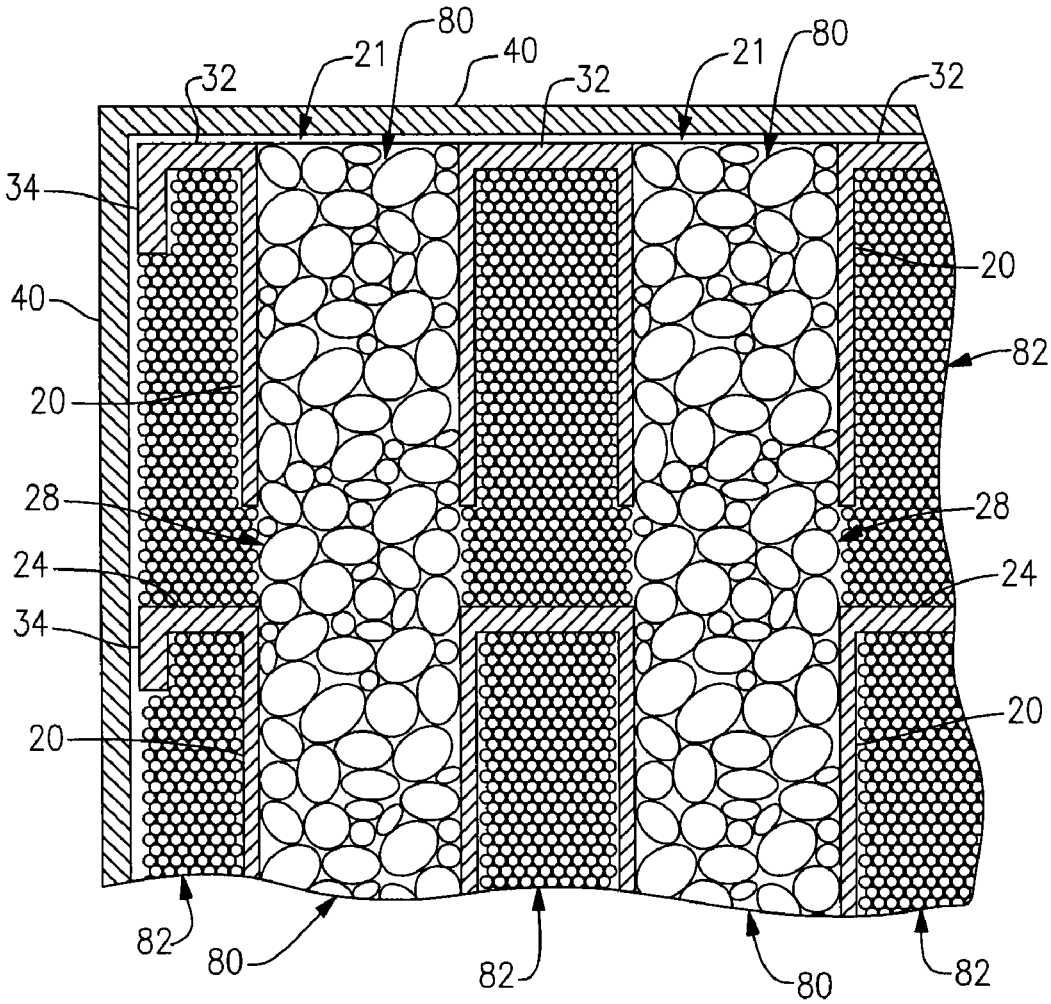
FIGS. 5A and 5B are each a partial cross-sectional illustration of the support structure shown in FIG. 4, with FIG. 5A depicting a first particulate material within the tubular columns and a second particulate material filling the region between and around the tubular columns, and FIG. 5B depicting a reinforcement bar extending through a cured, solid material filling the tubular columns and a particulate material filling the region between and around the tubular column.
Figure 5B:
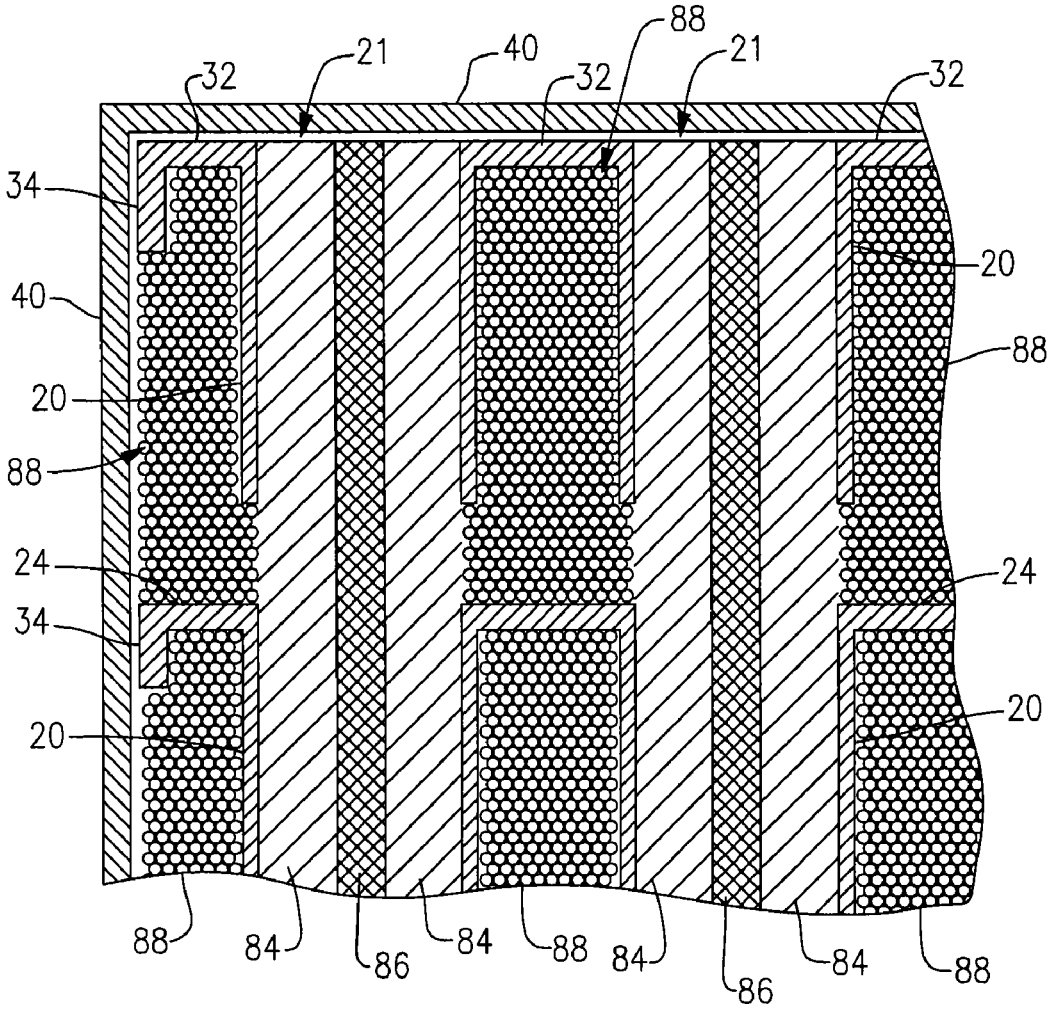

As shown in FIG. 5A, the tubular columns may be filled with a particulate material 80 such as gravel, and the region between and around the tubular columns may be filled with another type of particulate material 82, such as sand. As shown in FIG. 5B, the tubular columns may be filled with a curable, solid material 84 such as concrete through which a reinforcement bar 86 extends, and the region between and around the tubular columns may be filled with a particulate material 88, such as sand. The intersticial regions or voids between the tubular columns may be filled with a particulate matter, which may be the same as or different from, any particulate matter deposited in the tubular members. It is also within the contemplation of the invention that material may fill the voids between the tubular columns, but not within the tubular columns, and vice versa.

The support structure shown in FIG. 4 may be referred to as a block 50, which includes the stacked mats 10, any outer surrounding layers 40, and any material deposited into the tubular columns or between the tubular columns. It should be appreciated that the blocks 50 may be fashioned in a wide variety of different sizes and configurations. It should also be appreciated that the blocks 50 may be assembled either at a site that is remote from the installation site, or may be assembled in-situ at the installation site.

Figure 6:
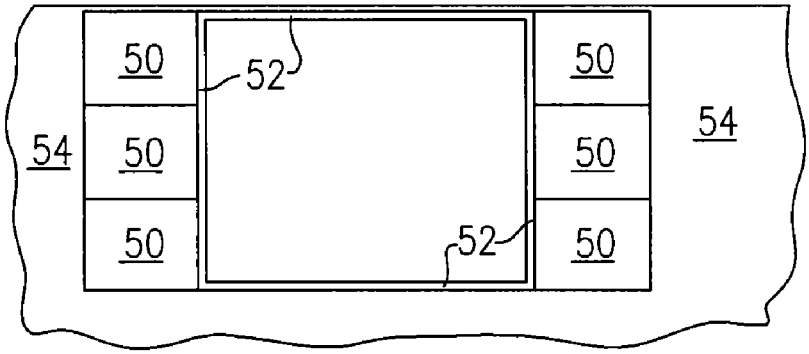
FIG. 6 is a schematic illustration of the support structures used in connection with an underground reservoir.

FIG. 6 illustrates how blocks 50 may be used to create an underground retaining wall for a reservoir that may be used to store solids or liquids such as petroleum. The reservoir may be defined by a peripheral wall 52, which may possess a rectangular configuration, with a pair of vertically extending, opposing side walls. A plurality of blocks 50 stacked on top of each other may be disposed adjacent to, and outside of, the vertically extending, opposing sections of the wall 52, and then dirt 54 may be backfilled around the blocks 50. If desired, a thin layer of dirt may extend over the top of the reservoir, and vegetation may be planted thereon.

The blocks 50 provide a strong, stabilizing abutment for both the vertically extending, opposing sections of the wall 52 as well as for the surrounding dirt 54. As such, the blocks 50 help prevent the configuration of the reservoir wall 52 from becoming distorted and the wall 52 from becoming damaged and punctured by forces acting on the surrounding dirt 54 or acting on the inside of the wall 52.

Figure 7:
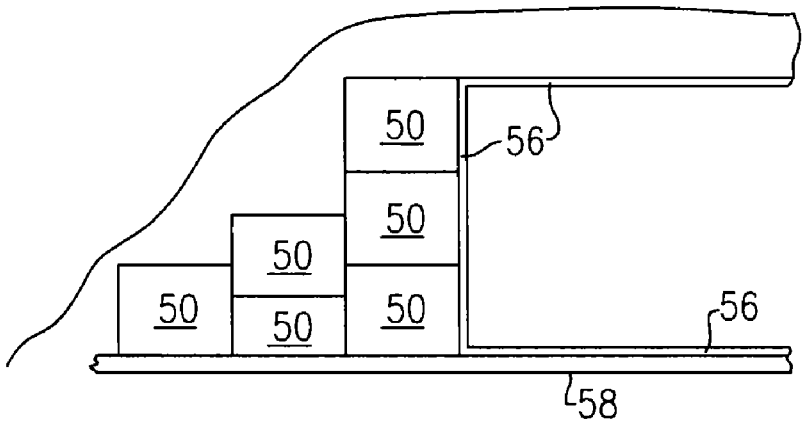
FIG. 7 is a schematic illustration of the support structures used in connection with an above-ground reservoir.

FIG. 7 shows a partial illustration of the use of blocks 50 in connection with an above-ground reservoir having a wall 56, which may be the same as the wall 52 shown in FIG. 5. In such a construction, the bottom portion of the wall 56 may rest upon a base layer 58 of gravel, concrete, or similar material. Likewise, a system of blocks 50 may rest upon the same base layer 58. As shown in FIG. 7, the blocks 50 are arranged in three rows, with the row adjacent to the vertical portion of the wall 56 being the highest, then the next adjacent row of blocks 50 being the next highest, and the third row of blocks 50 being the shortest. The blocks 50 are thus arranged in a tiered or terraced fashion of rows of different heights. Also, the heights of the blocks 50 in each row may be selected so that the horizontal interface between two adjacent blocks 50 in one row is not co-extensive with the horizontal interface between blocks 50 in an adjacent row.

It should also be appreciated that the present invention contemplates, although less preferred, that the lowermost blocks 50 in each of the least two adjacent rows may be of the same height and that the blocks 50 in the next highest row may be offset or staggered so that the vertical interfaces between blocks 50 in a lower layer are not co-extensive with the vertical interfaces between blocks 50 in the next higher layer.

Figure 8:
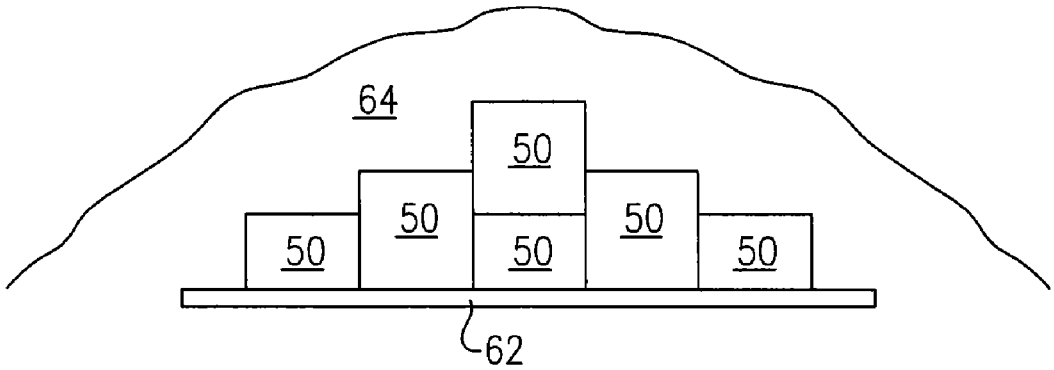
FIG. 8 is a schematic illustration of the support structures used in connection with a sand dune.

FIG. 8 illustrates how the blocks 50 may be arranged on a base layer 62 that may in all respects be similar to the base layer 58 shown in FIG. 6. In this embodiment, the blocks 50 are used to help prevent erosion of a sand dune 64. The base layer 62 is established, then the blocks 50 are arranged on the base layer 62, and then sand 64 is deposited over the blocks 50 and the base layer 62.

It should also be appreciated that the blocks 50 can themselves be arranged as pillars or posts, or other load-bearing structures, to help support roofs, and other types of loads.

From the foregoing description of the invention, it will be appreciated that the support structure of the present invention may be manufactured and installed relatively easily, inexpensively, and quickly and that the support structure provides relatively great strength and stability both laterally and vertically.

It is also contemplated within the scope of the present invention that the stacked mats 10 and blocks 50 may be constructed without any surrounding layers 40, and either the tubular columns or the voids between the tubular columns may be filled with dirt/soil. In such a simple embodiment, the stacked mats 10 should still provide stability, since migration of the dirt/soil will be inhibited by the tubular columns and by the other components of the mats 10.

While exemplary embodiments have been presented in the foregoing description of the invention, it should be appreciated that a vast number of variations within the scope of the invention may exist including other mat and block constructions and other methods of employing the support structures. The foregoing examples are not intended to limit the nature or the scope of the invention in any way. Rather, the foregoing detailed description provides those skilled in the art with a foundation for implementing other exemplary embodiments of the invention.

I claim:

1. A support structure including:

a plurality of mats, each mat including a substantially fixed matrix of spaced tubular rings, said mats being vertically stacked such that the tubular rings are co-extensive and form a matrix of tubular columns and such that a spaced region is formed between and around said tubular columns;

a cured, solid material substantially filling each of said tubular columns;

a particulate material substantially filling the spaced region between and around said tubular columns; and means for maintaining said particulate material from migrating away from the spaced region.

2. The support structure according to claim 1 wherein said cured, solid material consists essentially of concrete.

3. The support structure according to claim 1 wherein said maintaining means comprises a substantially liquid permeable geotextile fabric.

4. The support structure according to claim 1 wherein said maintaining means comprises a substantially liquid impermeable geomembrane.

5. The support structure according to claim 1 wherein said particulate material comprises a construction aggregate.

6. A support structure for supporting a wall, said structure including:

a plurality of mats, each mat including a substantially fixed matrix of spaced tubular rings, said mats being vertically stacked such that the tubular rings are co-extensive and form a matrix of tubular columns and such that a spaced region is formed between and around said tubular columns, the outer edges of said vertically stacked mats forming a peripheral surface;

said vertically stacked mats positioned such that the peripheral surface thereof is disposed immediately adjacent to said wall;

a cured, solid material substantially filling each of said tubular columns; and a particulate material substantially filling the spaced region between and around said tubular columns.

7. The support structure according to claim 6 further including means for maintaining said particulate material from migrating away from the spaced region.

8. A support structure including:

a plurality of blocks, each block including a plurality of mats, each mat including a substantially fixed matrix of spaced tubular rings, said mats being vertically stacked such that the tubular rings are co-extensive and form a matrix of tubular columns and said that a spaced region is formed between and around said tubular columns, each block including a cured, solid material substantially filling each of said tubular columns and also including a particulate material substantially filling the spaced region between and around said tubular columns; each block including an associated means for maintaining said particulate material from migrating away from the spaced region; and each block adapted to be moveable independent of each of the others of said plurality of blocks;

at least two blocks of said plurality of blocks arranged substantially horizontally side-by-side in a layer and at least one other block of said plurality of blocks stacked substantially vertically on top of the blocks in said layer.

9. The support structure according to claim 8 wherein said plurality of blocks are arranged to create at least one recessed tier of blocks.

10. The support structure according to claim 8 wherein said plurality of blocks are arranged in a plurality of rows, each row including at least two blocks of said plurality of blocks, and wherein said blocks in one row are vertically staggered with respect to said blocks in at least one adjacent row.

11. A method of installing a support structure comprising:

providing a plurality of mats, each mat including a substantially fixed matrix of spaced tubular rings, said mats being vertically stacked such that the tubular rings are co-extensive and form a matrix of tubular columns and such that a spaced region is formed between and around said tubular columns;

pouring a curable material while in a liquid or slurry form substantially throughout and within each of said tubular columns;

packing a particulate material substantially throughout the spaced region between and around said tubular columns; and wrapping said mats, said curable material, and said particulate material so as to maintain said particulate material from migrating away from the spaced region.

12. The method of installing a support structure according to claim 11 further comprising disposing a reinforcement bar within at least one tubular column while said curable material is in a liquid or slurry state.

13. A method of installing a support structure comprising:

a plurality of blocks, each block including a plurality of mats, each mat including a substantially fixed matrix of spaced tubular rings, said mats being vertically stacked such that the tubular rings are co-extensive and form a matrix of tubular columns and such that a spaced region is formed between and around said tubular columns, each block including a cured, solid material substantially filling each of said tubular columns and also including a particulate material substantially filling the spaced region between and around said tubular columns; each block including an associated means for maintaining said particulate material from migrating away from the spaced region; and each block adapted to be moveable independent of each of the others of said plurality of blocks;

arranging at least two blocks of said plurality of blocks in a substantially horizontal side-by-side layer; and stacking at least one other block of said plurality of blocks substantially vertically on top of the blocks in said layer.

* * * * *